US007841819B1

(12) United States Patent
Berres

(10) Patent No.: US 7,841,819 B1
(45) Date of Patent: Nov. 30, 2010

(54) PERSONAL FOOD CONVEYOR APPARATUS

(76) Inventor: Michael C. Berres, West 1748 Schaefer La., Marinette, WI (US) 54143

( * ) Notice: Subject to any disclaimer, the term of this patent is extended or adjusted under 35 U.S.C. 154(b) by 967 days.

(21) Appl. No.: 11/672,138

(22) Filed: Feb. 7, 2007

(51) Int. Cl.
*A47G 21/00* (2006.01)

(52) U.S. Cl. ..... 414/9

(58) Field of Classification Search ..... 414/9
See application file for complete search history.

(56) References Cited

U.S. PATENT DOCUMENTS 1,409,731 A * 3/1922 La Jeunesse ..... 414/9
1,933,275 A * 10/1933 Melucci ..... 414/9
3,885,681 A * 5/1975 Mancino ..... 414/9
5,037,261 A 8/1991 Morewood
5,282,711 A 2/1994 Frische
6,592,315 B2 7/2003 Osborne, Jr.
2005/0232725 A1 * 10/2005 Frank et al. ..... 414/9

* cited by examiner

*Primary Examiner*—Joe Dillon, Jr.
(74) *Attorney, Agent, or Firm*—Crossley Patent Law; Mark A. Crossley

(57) ABSTRACT

A personal food conveyor apparatus comprises a frame which provides for clamping to a table at the bottom end. The clamp is operated by a thumbscrew. The bottom of the frame further comprises a step which allows for a plate to fit closely to and under the leading edge of the frame bottom. The top of the frame comprises a landing platform for food. A user moves food from the plate to the conveyor ramp. The non-slip surface of the ramp delivers the food to the landing platform from whence the user can move food into their mouth. A switch on the side of the frame provides on/off ramp function. The conveyor assembly is removable from the frame, and is further capable of disassembly. The removability and disassembly provide for easy cleaning and for any needed parts replacement.

20 Claims, 3 Drawing Sheets

PERSONAL FOOD CONVEYOR APPARATUS

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

There has long been established a need for self-feeding apparatuses. A plethora of devices exist for self-feeding. Virtually all are complex and expensive. However, a need is also established for aiding those who can at least partially assist in feeding themselves. This need is unaddressed. Many individuals are physically challenged in delivering food from a plate to their mouths. Causes of self-feeding problems range from diabetes related illnesses to arthritis to any of a host of other ailments, especially those which cause hand shakiness and instability. The present apparatus provides a basic, inexpensively manufactured, easily cleaned personal food conveyor.

1. Field of the Invention

The personal food conveyor apparatus relates to an apparatus for aiding a person in feeding themselves.

2. Description of the Prior Art

Prior related art provides devices for those who have little or no ability to assist in feeding themselves. As example, U.S. Pat. No. 5,037,261 issued to Morewood 1991 Aug. 6 teaches a spoon support mechanism in a self-feeding device for handicapped persons. U.S. Pat. No. 6,592,315B2 issued to Osborne, Jr. 2003 Jul. 15 teaches a self-feeding apparatus with hover mode. U.S. Pat. No. 5,282,711 issued to Frische 1994 Feb. 1 teaches an assistive dining device, system and method. The above comprise exemplary complex devices which do not provide the basic mechanical, relatively inexpensive capabilities of the present apparatus.

While the above-described devices fulfill their respective and particular objects and requirements, they do not describe a personal food conveyor apparatus that provides for the advantages of the present personal food conveyor apparatus. In this respect, the present personal food conveyor apparatus substantially departs from the conventional concepts and designs of the prior art. Therefore, a need exists for an improved personal food conveyor apparatus.

SUMMARY OF THE INVENTION

The general purpose of the personal food conveyor apparatus, described subsequently in greater detail, is to provide a personal food conveyor apparatus which has many novel features that result in an improved personal food conveyor apparatus which is not anticipated, rendered obvious, suggested, or even implied by prior art, either alone or in combination thereof.

To attain this, the personal food conveyor apparatus comprises a frame which provides for clamping to a table at the bottom end. The clamp is operated by a thumbscrew. The bottom of the frame further comprises a step which allows for a plate to fit closely to and under the leading edge of the frame bottom. The top of the frame comprises a landing platform for food. A user moves food from the plate to the conveyor ramp. The non-slip surface of the ramp delivers the food to the landing platform from whence the user can move food into their mouth. A switch on the side of the frame provides on/off ramp function. The conveyor assembly is removable from the frame, and is further capable of disassembly. The removability and disassembly provide for easy cleaning and for any needed parts replacement.

The apparatus is lightweight and highly portable, so that those in need can easily transport and handle the apparatus. Lightweight, easily cleaned materials, such as plastics, are used in the construction of the apparatus. The motor is sealed, so that cleaning is not of concern. The switch is waterproof for the same reason.

Thus has been broadly outlined the more important features of the improved personal food conveyor apparatus so that the detailed description thereof that follows may be better understood and in order that the present contribution to the art may be better appreciated.

An object of the personal food conveyor apparatus is to provide an apparatus for aiding a person in feeding themselves.

Another object of the personal food conveyor apparatus is to be basic.

A further object of the personal food conveyor apparatus is to be easy to clean.

An added object of the personal food conveyor apparatus is to be usable with existing plates.

And, an object of the personal food conveyor apparatus is to assist in transfer of food from a plate to proximal to a user's mouth.

These together with additional objects, features and advantages of the improved personal food conveyor apparatus will be readily apparent to those of ordinary skill in the art upon reading the following detailed description of presently preferred, but nonetheless illustrative, embodiments of the improved personal food conveyor apparatus when taken in conjunction with the accompanying drawings.

In this respect, before explaining the current embodiments of the improved personal food conveyor apparatus in detail, it is to be understood that the personal food conveyor apparatus is not limited in its application to the details of construction and arrangements of the components set forth in the following description or illustration.

Those skilled in the art will appreciate that the concept of this disclosure may be readily utilized as a basis for the design of other structures, methods, and systems for carrying out the several purposes of the improved personal food conveyor apparatus. It is therefore important that the claims be regarded as including such equivalent constructions insofar as they do not depart from the spirit and scope of the personal food conveyor apparatus. It is also to be understood that the phraseology and terminology employed herein are for purposes of description and should not be regarded as limiting.

DETAILED DESCRIPTION OF THE DRAWINGS

With reference now to the drawings, and in particular FIGS. 1 through 6 thereof, the principles and concepts of the personal food conveyor apparatus generally designated by the reference number 10 will be described.

Figure 1:
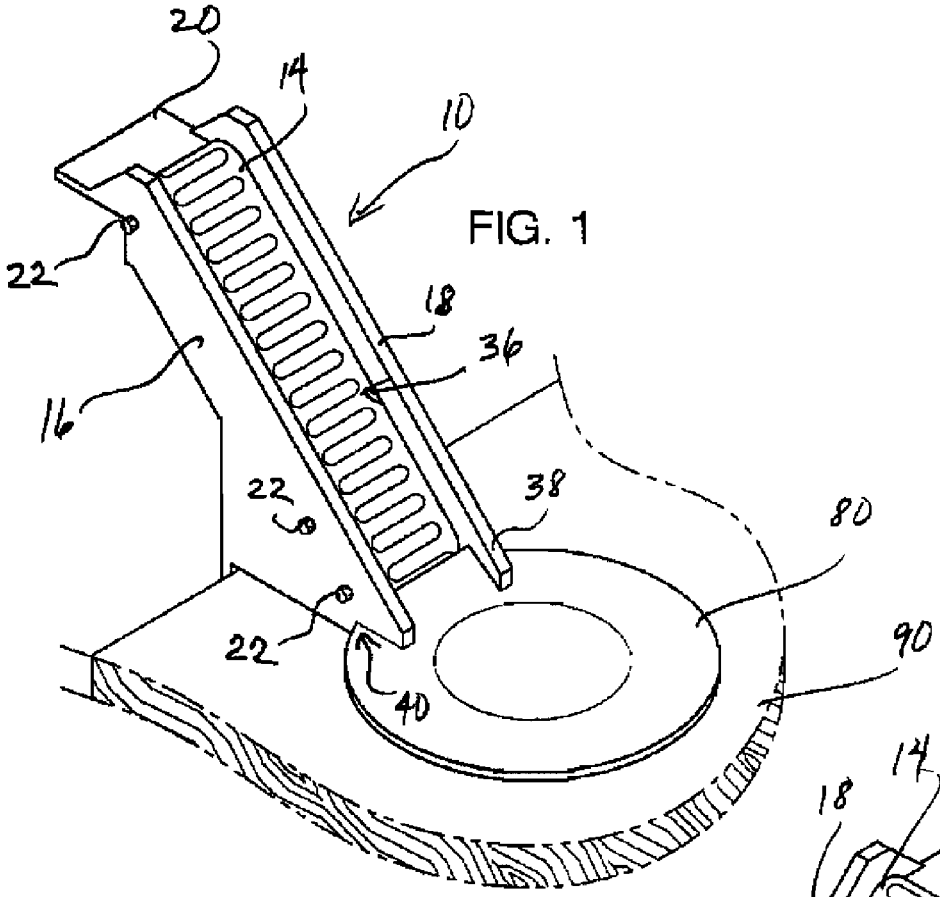
FIG. 1 is a perspective view of the apparatus fitted to a table, with plate fitted into the step.
Figure 2:
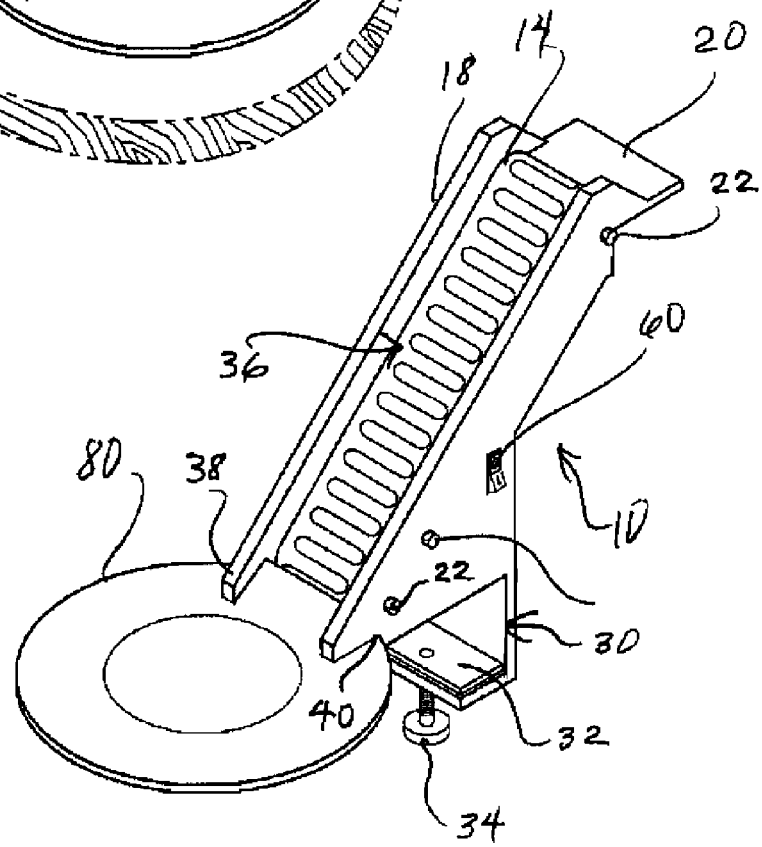
FIG. 2 is a perspective view of the apparatus with plate fitted into the overhang and step.
Figure 6:
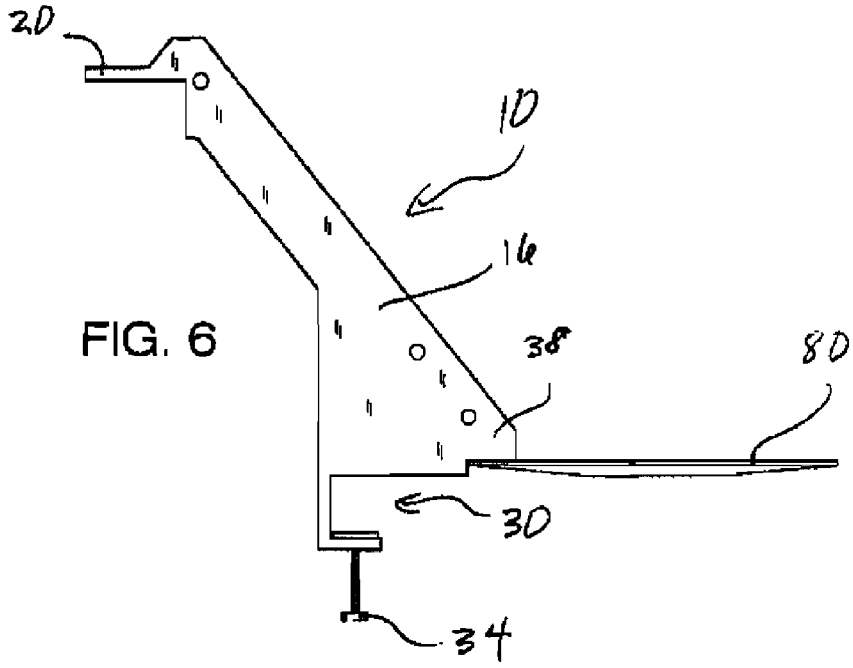
FIG. 6 is a side elevation view of the apparatus with plate fitted to the step.

Referring to FIGS. 1, 2, and 6, the personal food conveyor apparatus 10 comprises a frame 16 having a top, a bottom, and two spaced apart sides. A fence 18 is disposed on the top of each frame 16 side. An overhang 38 is extended from a front bottom each fence 18. The overhang 40 is further comprised of a step 40. The step 40 provides for fit of a plate 80 under the overhang 38 and on top of the table 90. The apparatus 10 thereby provides for firm attachment to a table 90 and level placement of the plate 80 under the overhang 38. The table 90 attachment mechanism comprises the horizontal u-channel 30 disposed at the bottom of the frame 16. The u-channel 30 has a top, a back, and a bottom. The top of the u-channel 30 is joined with each overhang 38 step 40 of each fence 18. The vertically movable clamp 32 is disposed within the bottom of the u-channel 30. The thumbscrew 34 is provided for moving the clamp 32 up and down. The clamp 32 thereby provides for firm attachment of the apparatus 10 to the table 90.

Figure 3:
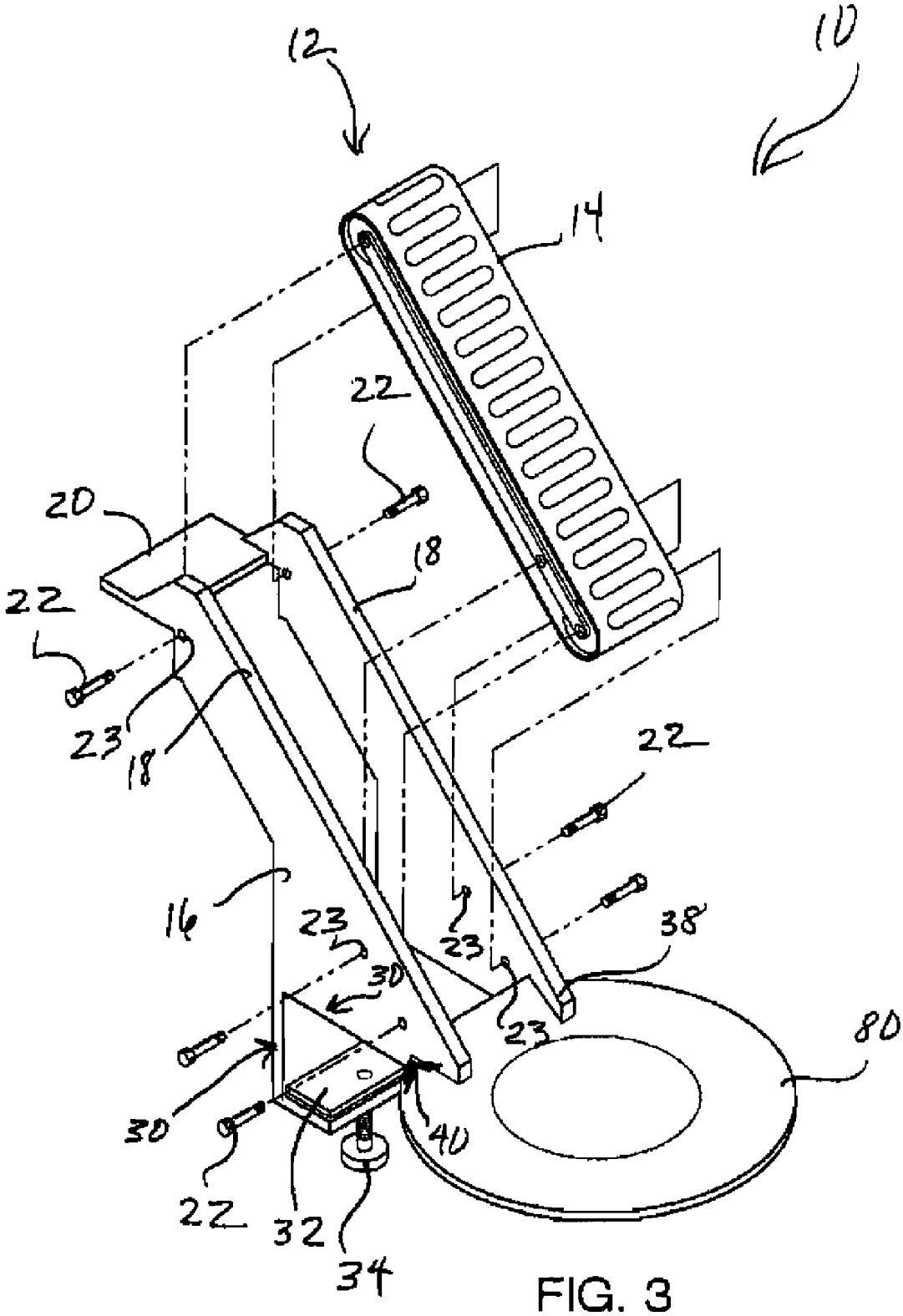
FIG. 3 is a perspective view of the apparatus with plate fitted into the step, the conveyor assembly removed.
Figure 4:
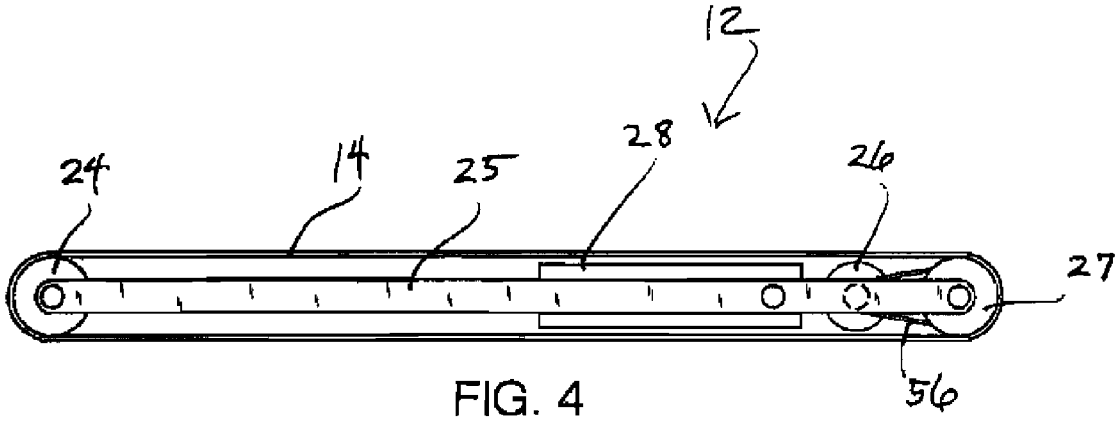
FIG. 4 is a side elevation view of the conveyor assembly.
Figure 5:
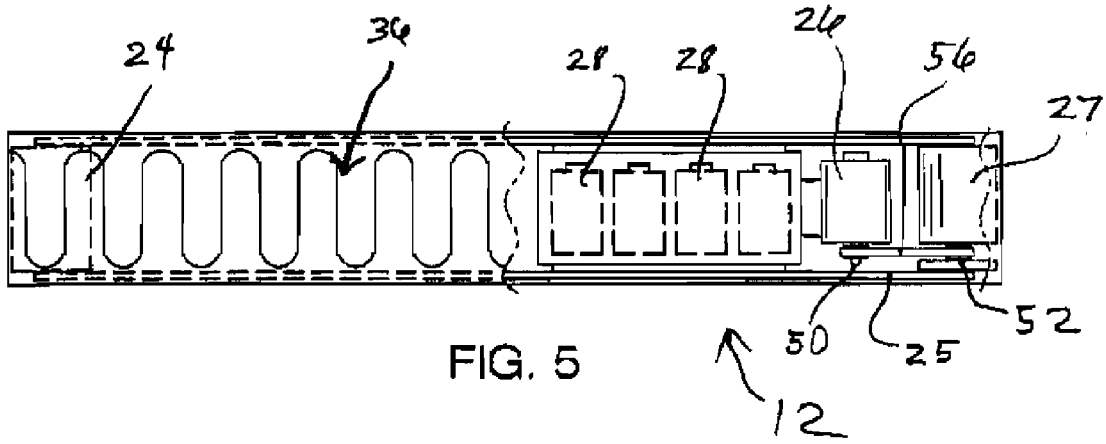
FIG. 5 is a top partial cross sectional view of the conveyor assembly.

Referring to FIGS. 3, 4, and 5, the conveyor assembly 12 is removably disposed between the frame 16 sides. The conveyor assembly 12 is at a plane parallel to and below the fences 18. The conveyor assembly 12 comprises a pair of parallel spaced apart struts 25. The struts 25 and conveyor assembly 12 are removably held within the frame via the plurality of anchors 22.

Each anchor removably fits within one of the orifices 23 of the frame 16 and thence into a strut 25. Removability of the conveyor assembly 12 provides for easy cleaning of the apparatus 10. The slave wheel 24 is disposed at one end of the struts 25. The drive wheel 27 is disposed at the end of the struts 25 opposite the slave wheel 24. The ramp 14 connects the drive wheel 27 to the slave wheel 24. At least one battery 28 is disposed between the struts 25. Ideally, the plurality of batteries 28 are fitted to extended operation of the conveyor assembly 12. The switch 60 controls the on and off of the conveyor assembly 12. The motor 26 is disposed between the struts 25 and proximal to the drive wheel 27. The motor pulley 50 is disposed on the motor 26. The wheel pulley 50 is disposed on the drive wheel 27. The belt 56 connects the motor pulley 50 to the wheel pulley 52. The landing platform 20 is affixed to the top of the frame 16. 18. The conveyor assembly 12 is capable of disassembly. Disassembly further aids cleaning and provides for any needed parts replacements. The ramp 14 is comprised of a non-slip surface 36 for best conveying food from the bottom of the frame 16 to the landing platform 20.

With respect to the above description then, it is to be realized that the optimum dimensional relationships for the parts of the personal food conveyor apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the personal food conveyor apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the personal food conveyor apparatus may be used.

Therefore, the foregoing is considered as illustrative only of the principles of the personal food conveyor apparatus. Further, since numerous modifications and changes will readily occur to those skilled in the art, it is not desired to limit the personal food conveyor apparatus to the exact construction and operation shown and described, and accordingly, all suitable modifications and equivalents may be resorted to, falling within the scope of the personal food conveyor apparatus.

What is claimed is:

1. A personal food conveyor apparatus, comprising:
- a frame having a top, a bottom, and two spaced apart sides;
- a landing platform affixed to the top of the frame;
- a fence on a top of each frame side;
- an overhang extended from a front bottom of each fence;
- a step in the overhang;
- means for removably affixing the apparatus to a table;
- a conveyor assembly disposed between the frame sides, the step, and the landing platform, the conveyor assembly at a plane below the fences;
- battery power for the conveyor assembly;
- a switch for controlling the conveyor assembly;
- a ramp continuously disposed between the frame bottom and the landing platform, wherein the ramp conveys food from the bottom of the frame to the landing platform whereby a person self-feeds.

2. The apparatus according to claim 1 wherein the conveyor assembly is further removable.

3. The apparatus according to claim 1 wherein the conveyor assembly is further partially comprised of a ramp;
- a non-slip surface on the ramp.

4. The apparatus according to claim 2 wherein the conveyor assembly is further partially comprised of a ramp;
- a non-slip surface on the ramp.

5. A personal food conveyor apparatus, comprising:
- a frame having a top, a bottom, and two spaced apart sides;
- a landing platform affixed to the top of the frame;
- a fence on a top of each frame side;
- an overhang extended from a front bottom of each fence;
- a table attachment mechanism, the mechanism comprising:
  - a horizontal u-channel disposed at the bottom of the frame, the u-channel having a top, a back, and a bottom, the top of the u-channel joined with each overhang of each fence;
  - an vertically movable clamp within the bottom of the u-channel;
  - a thumbscrew for moving the clamp;
- a conveyor assembly disposed between the frame sides, the overhang, and the landing platform, the conveyor assembly at a plane below the fences;
- battery power for the conveyor assembly;
- a switch for controlling the conveyor assembly;
- a ramp continuously disposed between the frame bottom and the landing platform, wherein the ramp conveys food from the bottom of the frame to the landing platform whereby a person self-feeds.

6. The apparatus according to claim 5 wherein the conveyor assembly is further removable.

7. The apparatus according to claim 6 wherein the conveyor assembly is further capable of disassembly.

8. The apparatus according to claim 5 wherein the conveyor assembly is further partially comprised of a ramp;

a non-slip surface on the ramp.

9. The apparatus according to claim 6 wherein the conveyor assembly is further partially comprised of a ramp;

a non-slip surface on the ramp.

10. The apparatus according to claim 7 wherein the conveyor assembly is further partially comprised of a ramp;

a non-slip surface on the ramp.

11. The apparatus according to claim 5 wherein the overhang is further comprised of a step.

12. The apparatus according to claim 6 wherein the overhang is further comprised of a step.

13. The apparatus according to claim 7 wherein the overhang is further comprised of a step.

14. The apparatus according to claim 8 wherein the overhang is further comprised of a step.

15. The apparatus according to claim 9 wherein the overhang is further comprised of a step.

16. The apparatus according to claim 10 wherein the overhang is further comprised of a step.

17. A personal food conveyor apparatus, comprising:

a frame having a top, a bottom, and two spaced apart sides;

a landing platform affixed to the top of the frame;

a fence on a top of each frame side;

an overhang extended from a front bottom of each fence;

a step in the overhang;

a table attachment mechanism, the mechanism comprising:

a horizontal u-channel disposed at the bottom of the frame, the u-channel having a top, a back, and a bottom, the top of the u-channel joined with each overhang step of each fence;

an vertically movable clamp within the bottom of the u-channel;

a thumbscrew for moving the clamp;

a conveyor assembly removably disposed between the frame sides, the overhang, and the landing platform, the conveyor assembly at a plane below the fences, the conveyor assembly comprising:

a pair of parallel spaced apart struts;

a slave wheel disposed at a one end of the struts;

a drive wheel disposed at an end of the struts opposite the slave wheel;

a ramp connecting the drive wheel to the slave wheel;

at least one battery disposed between the struts;

a motor disposed between the struts;

a motor pulley disposed on the motor;

a wheel pulley disposed on the drive wheel;

a belt connecting the motor pulley to the wheel pulley;

a switch for controlling the conveyor assembly;

a ramp continuously disposed between the frame bottom and the landing platform, wherein the ramp conveys food from the bottom of the frame to the landing platform whereby a person self-feeds.

18. The apparatus according to claim 17 wherein the conveyor assembly is further capable of disassembly.

19. The apparatus according to claim 17 wherein the ramp is further comprised of a non-slip surface.

20. The apparatus according to claim 18 wherein the ramp is further comprised of a non-slip surface.

* * * * *